US008091282B2

(12) United States Patent
Speyer et al.

(10) Patent No.: US 8,091,282 B2
(45) **Date of Patent: *Jan. 10, 2012**

(54) COMBINED SEALING SYSTEM AND SEAL ACTIVATION SYSTEM FOR DOOR/WINDOW

(75) Inventors: William Kip Speyer, Boca Raton, FL (US); Jonathan D Thielmann, Boca Raton, FL (US); Robert E Pruss, Delray Beach, FL (US)

(73) Assignee: Secura-Seal Technologies LLC, Bensalem, PA (US)

( * ) Notice: Subject to any disclaimer, the term of this patent is extended or adjusted under 35 U.S.C. 154(b) by 1145 days.

This patent is subject to a terminal disclaimer.

(21) Appl. No.: 11/425,382

(22) Filed: Jun. 20, 2006

(65) Prior Publication Data

US 2007/0163181 A1 Jul. 19, 2007

Related U.S. Application Data

(63) Continuation-in-part of application No. 11/322,953, filed on Dec. 30, 2005, now Pat. No. 7,685,776.

(51) Int. Cl.
*E06B 7/28* (2006.01)

(52) U.S. Cl. ..... 49/317; 49/321; 49/316

(58) Field of Classification Search ..... 49/316, 49/317, 318, 319, 320, 321
See application file for complete search history.

(56) References Cited

U.S. PATENT DOCUMENTS

| | | | | |
|---|---|---|---|---|
| 19,217 | A | | 1/1858 | Tinney |
| 724,139 | A | | 3/1903 | Smith |
| 946,305 | A | | 1/1910 | Twyman |
| 982,828 | A | * | 1/1911 | Kelly ..... 49/319 |
| 1,009,978 | A | * | 11/1911 | Knappe ..... 49/255 |
| 1,021,862 | A | | 4/1912 | Culver |
| 1,170,101 | A | | 2/1916 | Pullets |
| 1,178,775 | A | * | 4/1916 | Albright ..... 49/318 |
| 1,345,967 | A | | 7/1920 | Smelser |
| 1,468,958 | A | | 9/1923 | Champion |
| 1,489,018 | A | | 4/1924 | Shultz |
| 1,675,230 | A | | 6/1928 | Snyder |
| 1,715,188 | A | | 5/1929 | Bullock |
| 1,797,839 | A | | 3/1931 | Ramsay |
| 1,974,269 | A | | 9/1934 | Gonder |
| 1,977,726 | A | | 10/1934 | Jacobson |
| 1,995,939 | A | | 3/1935 | Osten |
| 2,207,065 | A | * | 7/1940 | McCormick ..... 49/318 |

(Continued)

OTHER PUBLICATIONS

Dictionary.com, "Active," retrieved online at: http://dictionary.reference.com/browse/active (2010).

(Continued)

*Primary Examiner* — Gregory J. Strimbu
(74) *Attorney, Agent, or Firm* — Nelson Mullins Riley & Scarborough LLP; Anthony A. Laurentano

(57) ABSTRACT

A combination sealing system and seal activation system for use with a combination of a panel and a frame includes a first sealing system and a first seal activation system for activating the first sealing system. The first sealing system is positioned within the frame, and the first seal activation system is positioned within panel and includes a movable member configured to engage the first sealing system. The first sealing system includes a movable member. The movable member of the first sealing system is caused to move towards the panel to form a seal between the panel and the frame when the movable member of the first seal activation system moves towards the frame.

20 Claims, 12 Drawing Sheets

U.S. PATENT DOCUMENTS 2,248,719 A 7/1941 Owen
2,268,114 A 12/1941 Foster
2,541,421 A 2/1951 Hunter
2,552,369 A 5/1951 Currie
2,593,093 A 4/1952 Bjork
2,628,678 A 2/1953 Webster
2,719,342 A 10/1955 Hunt
2,753,020 A 7/1956 Ware
2,766,860 A * 10/1956 Travis ..... 49/318
2,805,451 A 9/1957 Evans
2,837,151 A 6/1958 Stroup
2,662,262 A 12/1958 Shea
2,862,256 A 12/1958 Stroup
2,928,144 A 3/1960 Persson
3,004,309 A 10/1961 Korodi
3,054,152 A 9/1962 Trammell
3,059,287 A 10/1962 Baruch
3,070,856 A 1/1963 Minick
3,077,644 A 2/1963 Kesling
3,098,519 A 7/1963 Meyer et al.
3,111,727 A 11/1963 Gerecke
3,126,051 A 3/1964 Sussin
3,163,891 A 1/1965 Seliger
3,184,806 A 5/1965 Bragman
3,252,255 A 5/1966 Marpe
3,289,377 A 12/1966 Hetman
3,295,257 A * 1/1967 Douglass ..... 49/317
3,335,524 A 8/1967 Carson
3,374,821 A 3/1968 White
3,383,801 A 5/1968 Dallaire
3,466,801 A 9/1969 Bohn
3,512,303 A 5/1970 Wright
3,590,530 A 7/1971 Duguay
3,590,531 A 7/1971 Childs
3,660,936 A 5/1972 Bryson
3,660,940 A 5/1972 Tavano
3,816,966 A 6/1974 Sause, Jr.
3,818,636 A 6/1974 Calais et al.
3,821,884 A 7/1974 Walsh
3,848,908 A 11/1974 Rich
3,857,199 A 12/1974 Frach et al.
3,910,155 A 10/1975 Wilson
3,959,927 A 6/1976 Good
4,018,022 A 4/1977 Fink
4,027,431 A 6/1977 Rackard
4,064,651 A * 12/1977 Homs ..... 49/319
4,128,967 A 12/1978 Kirsch
4,170,846 A 10/1979 Dumenil et al.
4,307,542 A 12/1981 Lense
4,317,312 A 3/1982 Heideman
4,322,914 A 4/1982 McGaughey
4,392,329 A 7/1983 Suzuki
4,413,446 A 11/1983 Dittrich
4,453,346 A 6/1984 Powell et al.
4,479,330 A 10/1984 Muller
4,496,942 A 1/1985 Matsuoka
4,535,563 A 8/1985 Mesnel
4,614,060 A 9/1986 Dumenil et al.
4,656,779 A * 4/1987 Fedeli ..... 49/318
4,656,799 A 4/1987 Maryon
4,716,693 A 1/1988 Webster
4,765,105 A 8/1988 Tissington et al.
4,768,316 A 9/1988 Haas
4,831,509 A 5/1989 Jones et al.
4,837,560 A 6/1989 Newberry
4,870,909 A 10/1989 Richter
4,936,049 A 6/1990 Hansen
5,007,202 A 4/1991 Guillon
5,020,292 A 6/1991 Strom et al.
5,029,911 A 7/1991 Daniels
5,030,488 A 7/1991 Sobolev
5,187,867 A 2/1993 Rawlings
5,293,726 A 3/1994 Schick
5,327,684 A 7/1994 Herbst
5,339,881 A 8/1994 Owens
5,349,782 A 9/1994 Yulkowski
5,379,518 A 1/1995 Hopper
5,446,997 A 9/1995 Simonton
5,467,559 A 11/1995 Owens
5,479,151 A 12/1995 Lavelle et al.
5,511,833 A 4/1996 Tashman et al.
5,521,585 A 5/1996 Hamilton
5,522,180 A 6/1996 Adler et al.
5,522,195 A 6/1996 Bargen
5,569,878 A 10/1996 Zielinski
5,584,142 A 12/1996 Spiess
5,605,013 A 2/1997 Hogston
5,638,639 A 6/1997 Goodman et al.
5,784,834 A 7/1998 Stutzman
5,786,547 A 7/1998 Zielinski
5,870,859 A 2/1999 Kitada
5,870,869 A 2/1999 Schrader
5,964,060 A 10/1999 Furlong
6,041,552 A 3/2000 Lindahl
6,057,658 A 5/2000 Kovach et al.
6,082,047 A 7/2000 Comaglio et al.
6,105,313 A 8/2000 Holloway et al.
6,112,466 A 9/2000 Smith et al.
6,112,467 A 9/2000 Bark et al.
6,112,496 A 9/2000 Hugus et al.
6,170,195 B1 1/2001 Lim
6,173,533 B1 1/2001 Cittadini et al.
6,181,089 B1 1/2001 Kovach et al.
6,202,353 B1 3/2001 Giacomelli
6,218,939 B1 4/2001 Peper
6,243,999 B1 6/2001 Silverman
6,289,643 B1 9/2001 Bonar
6,318,037 B1 11/2001 Hansen
6,442,899 B1 9/2002 Gledhill
6,490,832 B1 12/2002 Fischbach et al.
D470,252 S 2/2003 Castrey
6,546,682 B1 4/2003 DeBlock et al.
6,553,735 B1 4/2003 Wang Chen
6,568,131 B1 5/2003 Milano, Jr.
6,619,005 B1 9/2003 Chen
6,644,884 B2 11/2003 Gledhill
6,651,389 B2 11/2003 Minter
6,772,818 B2 8/2004 Whitley et al.
6,786,005 B1 9/2004 Williams
6,871,902 B2 3/2005 Carson et al.
6,973,753 B2 12/2005 Liebscher
7,010,888 B2 3/2006 Tumlin et al.
7,124,538 B1 10/2006 Kline
7,145,436 B2 12/2006 Ichikawa et al.
7,185,468 B2 3/2007 Clark et al.
7,487,616 B2 2/2009 Deaver
7,566,035 B2 7/2009 Bonshor
7,624,539 B2 12/2009 Speyer et al.
7,627,987 B2 12/2009 Thielmann et al.
7,665,245 B2 2/2010 Speyer et al.
7,685,774 B2 3/2010 Thielmann
7,685,775 B2 3/2010 Speyer et al.
7,685,776 B2 3/2010 Speyer et al.
7,707,773 B2 5/2010 Thielmann et al.
7,719,213 B2 5/2010 Herman et al.
2003/0033786 A1 2/2003 Yulkowski
2004/0068935 A1 4/2004 Ichikawa et al.
2005/0097842 A1 5/2005 Arcamonte et al.
2005/0102908 A1 5/2005 Martin
2006/0207199 A1 9/2006 Darnell
2007/0289221 A1 12/2007 Speyer et al.
2009/0151259 A1 6/2009 Speyer et al.
2009/0165415 A1 7/2009 Salerno
2009/0165423 A1 7/2009 Salerno
2010/0077665 A1 4/2010 Speyer et al.

OTHER PUBLICATIONS

International Search Report for Application No. PCT/US2010/029383, dated May 25, 2010.
International Search Report for Application No. PCT/US2010/029206, dated Jun. 2, 2010.
Patio Life—Operation; http://www.rotohardware.com/Products/Patio%20Life/PL-Operation.htm, Sep. 30, 2006.

* cited by examiner

COMBINED SEALING SYSTEM AND SEAL ACTIVATION SYSTEM FOR DOOR/WINDOW

CROSS-REFERENCE TO RELATED APPLICATIONS

This application is a Continuation-In-Part of U.S. application Ser. No. 11/322,953, filed on Dec. 30, 2005, issued as U.S. Pat. No. 7,685,776 on Mar. 30, 2010, which is incorporated herein by reference in its entirety.

BACKGROUND OF THE INVENTION

1. Field of the Invention

The disclosure relates generally to sealing systems for use with panels, such as a door or a window, within a frame and, more specifically, to a sealing system for providing an improved seal between a panel and frame.

2. Description of the Related Art

Certain types of panels, such as doors and windows, are positioned within openings of a wall and/or other structures using a frame. These panels may also open and close by pivoting relative to the frame. An issue associated with these types of panels is the integrity of the seals between the panels and the frame. In many instances, these seals are an insufficient barrier in preventing the transfer of such environmental elements as noise, weather, water, and insects from one side of the panel to the other side.

Attempts have been made to address these issues by using various types of weather stripping between the panels and frame. For example, the weather stripping may be strip of felt, foam, or a pile of flexible synthetic material. In many instances, however, this weather stripping fails to act as a sufficient seal between the panels and frame. Another issue prevalent associated with the seals between a frame and panel or between adjacent panels is that these seals can become disjoined. Either intentionally or unintentionally, the alignment between the frame and panel or between adjacent panels may be disturbed which can degrade the quality of the seal, since, in many instances, the integrity of the seal relies upon these members having certain positional relationships relative to one another.

There is, therefore, also a need for a sealing system that maintains the positional relationships between the frame and panel. A need also exists for a sealing system that can be employed between a frame and panel that prevents the transfer from one side of the panel to the other side of the panel such environmental effects as noise, weather, water, heat/cold, and insects

BRIEF SUMMARY OF THE INVENTION

Embodiments of the invention address deficiencies of the art with respect to effectively creating a seal between a panel and a frame. In this regard, a combined sealing system and seal activation system for use with the panel and the frame includes a first sealing system and a first seal activation system for activating the first sealing system. The first sealing system is positioned within the frame, and the first seal activation system is positioned within the panel and includes a movable member configured to engage the first sealing system. The first sealing system includes a movable member, and the movable member of the first sealing system is caused to move towards the panel by the first sealing system being engaged by the movable member of the first seal activation system moving towards the frame.

In certain aspects of the combined sealing system and seal activation system, the first sealing system includes a reciprocal motion device connected to the frame, and an anchor connected to the reciprocal motion device. Movement of a portion of the reciprocal motion device away from the panel moves the anchor towards the panel. Also, the first sealing system includes a first cam pivotally connected to the panel, and a first activation pin pivotally connected to the first cam. A plurality of reciprocal motion devices are connected to the anchor, and the panel pivots relative to the frame.

In other aspects of the combined sealing system and seal activation system, in an engaged configuration of the first seal activation system, the movable member of the first sealing system engages a portion of the panel to form a seal between the panel and the frame and the movable member of the first sealing system extends into a slot within the panel to prevent movement of the panel relative to the frame.

In further aspects of the combined sealing system and seal activation system, a second sealing system is positioned within the frame on one side of the frame, and a second seal activation system is included for activating the second sealing system and positioned with the panel. The first sealing system is positioned within the frame on another side of the frame different than the one side of the frame. Also, the first and second seal activation systems are interconnected with a connecting member, and positioning the first seal activation system to an engaged configuration causes positioning of all the seal activation systems to an engaged configuration.

In yet other aspects of the combined sealing system and seal activation system, a second sealing system is positioned within the frame on one side of the frame, and the first sealing system is positioned within the frame on another side of the frame different than the one side of the frame. The first seal activation system also activates the second sealing system.

In still other aspects, a combined sealing system a first sealing system and a second sealing system. The first sealing system creates a seal between a first surface of the frame and a first surface of the panel. The second sealing system creates a seal between a second surface of the frame and a second surface of the panel. The first sealing system including a first movable member, and the second sealing system including a second movable member. The first surface of the panel is different than the second surface of the panel. Also, the first surface of the panel is substantially perpendicular to the second surface of the panel. Each of the first and second sealing systems includes an anchor extending from one of the frame and the panel. The panel pivots relative to the frame.

Additional aspects of the invention will be set forth in part in the description which follows, and in part will be obvious from the description, or may be learned by practice of the invention. The aspects of the invention will be realized and attained by means of the elements and combinations particularly pointed out in the appended claims. It is to be understood that both the foregoing general description and the following detailed description are exemplary and explanatory only and are not restrictive of the invention, as claimed.

BRIEF DESCRIPTION OF THE SEVERAL VIEWS OF THE DRAWINGS

The accompanying drawings, which are incorporated in and constitute part of this specification, illustrate embodiments of the invention and together with the description, serve to explain the principles of the invention. The embodiments illustrated herein are presently preferred, it being understood, however, that the invention is not limited to the precise arrangements and instrumentalities shown, wherein.

DETAILED DESCRIPTION OF THE INVENTION

Figure 1:
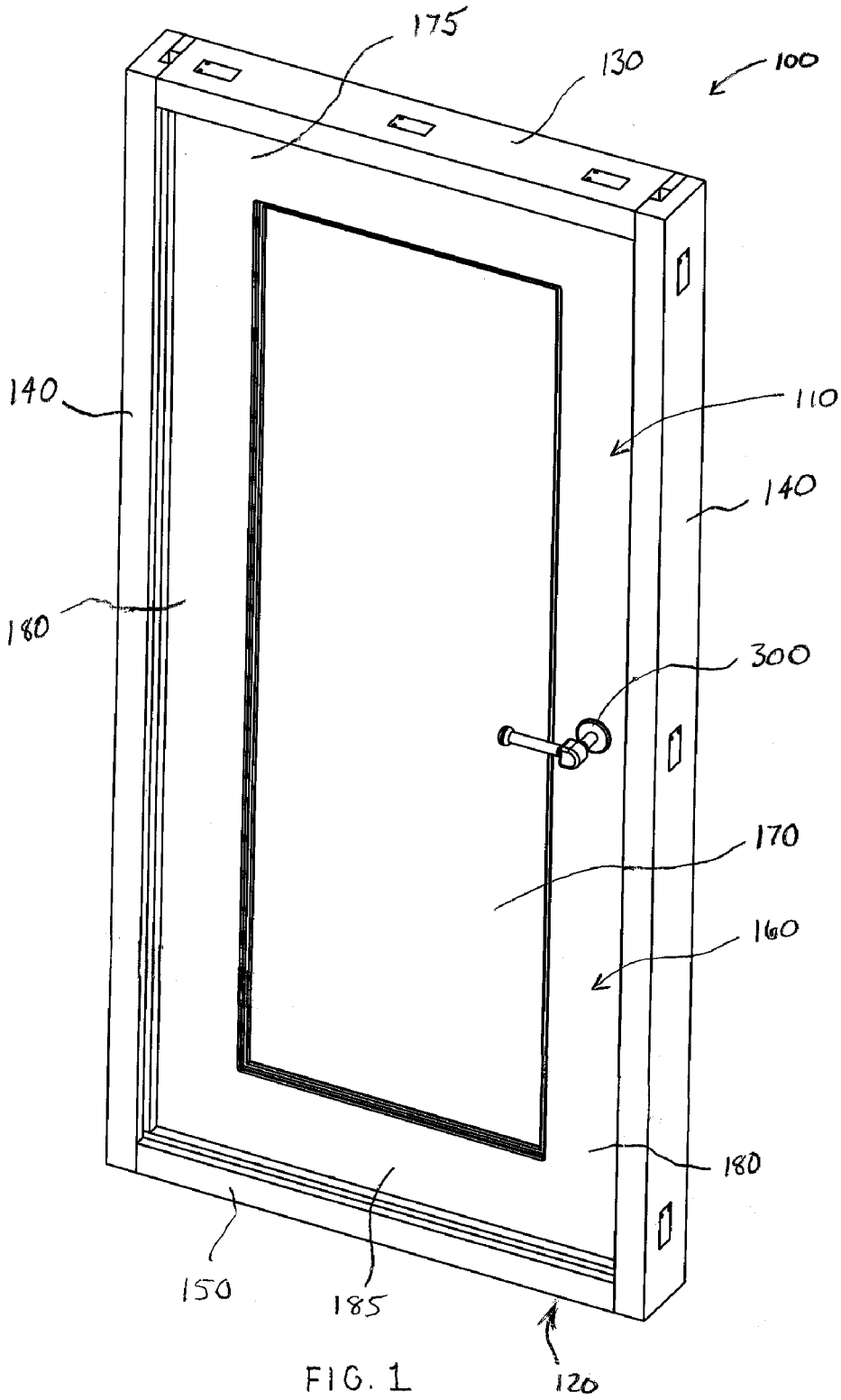
FIG. 1 is a perspective view of a door/window system in a closed position in accordance with the inventive arrangements.
Figure 2:
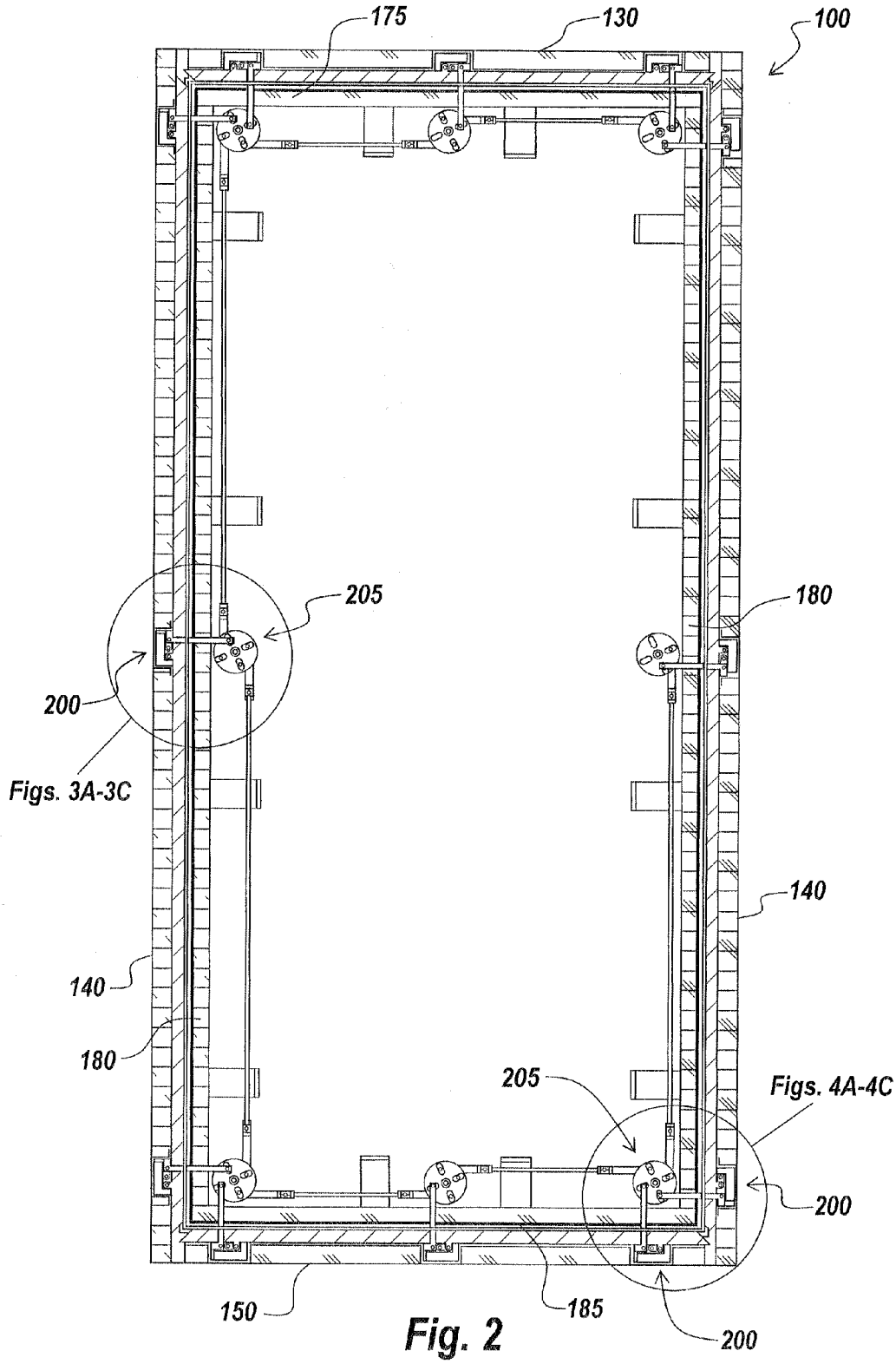
FIG. 2 is a front, partial cross-sectional view of the door/window system in accordance with the inventive arrangements.
Figure 3A:
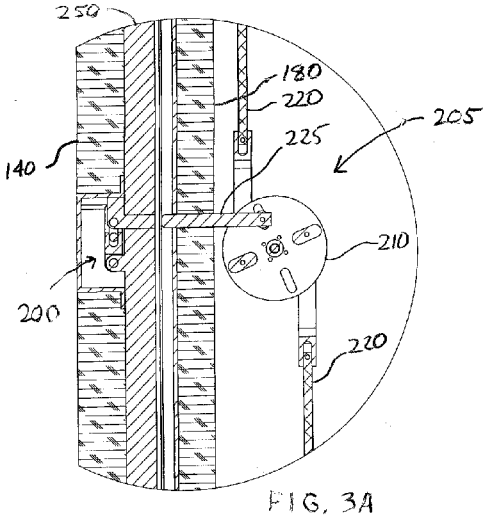
FIGS. 3A-3C are isolated detail views of the combination sealing system and seal activation system in accordance with the inventive arrangements at a side of the door/window system, respectively, in the unlocked, partially engaged, and locked configurations.
Figure 3B:
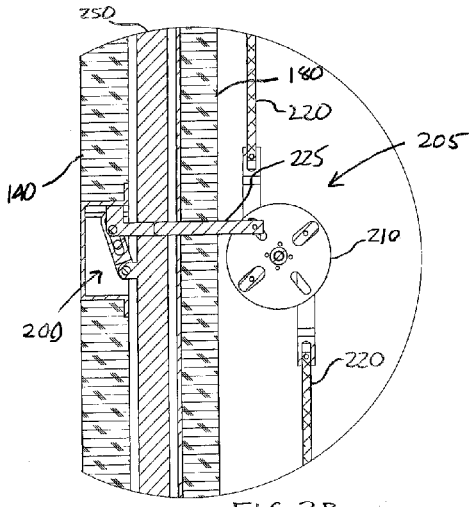
Figure 3C:
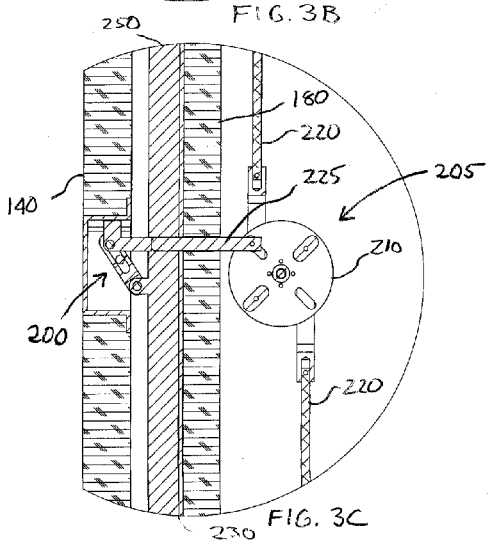

FIG. 1 illustrates an exemplar door/window system 100 for use with the combination sealing system 200 and seal activation system 205. The combination sealing system 200 and seal activation system 205 can be used with many types of doors and/or windows, and the combination sealing system 200 and seal activation system 205 is not limited to the particular door/window system 100 illustrated. For example, the combination sealing system 200 and seal activation system 205 may be used with pocket doors, sliding doors, French doors, entry doors, garage doors, sliding windows, single-hung windows, double-hung windows, casement windows, and awning windows. The door/window system 100 includes at least one panel 110 connected to a stationary frame 120. Although not limited in this manner, the panel 110 may pivot relative to the frame 120.

The frame 120 may include a header 130, jambs 140, and a sill 150. A header 130 is a structural member that spans an upper portion of the window/door opening. Jambs 140 are the outermost vertical side members of the frame 120. A sill 150 is a threshold or structural member that spans a lower-most portion of the window/door opening. As recognized by those skilled in the art, different terms may also be associated with the above-structure identified as the header 130, jambs 140, and sill 150.

The panel 110 may include a sash 160 that surrounds a pane 170. The pane 170 is not limited as to a particular material. For example, the pane 170 may be translucent, such as glass or plastic, opaque, such as with wood or metal, or any combination thereof. The sash may include a header rail 175, jamb or stile rails 180, and a sill rail 185. As recognized by those skilled in the art, different terms may also be associated with the structure identified as the header rail 175, the jamb or stile rail 180, and sill rail 185.

Referring to FIGS. 2, 3A-3C, and 4A-4C, the combination sealing system 200 and seal activation system 205 may be used with each of the members 175, 180, 185 of the sash 160 to form a seal 230 (see FIGS. 3C, 4C) between each pair of adjacent surfaces of the sash 160 of the panel 110 and the frame 120. In this manner, each of the separate sides of the panel 110 may employ the combination sealing system 200 and seal activation system 205. As will be described in more detail below, not only does the combination sealing system 200 and seal activation system 205 provide at least one seal between adjacent members of sash 160 and frame 120, the combination sealing system 200 and seal activation system 205 may be configured to prevent the movement of the panel 110 relative to the frame 120. In so doing, the combination sealing system 200 and seal activation system 205 can act as a lock and/or security device that prevents the forced opening of the panel 110 relative to the frame 120. Many types of sealing systems 200 and seal activation systems 205 so capable are known in the art, and the present door/window system 100 is not limited as to a particular type of sealing system 200 or sealing activation system 205.

Although the present door/window system 100 is described herein with particular types of sealing systems 200 being positioned in particular locations in the frame 120, the door/window system 100 is not limited as to a particular type of sealing system 200 and/or a particular location of the sealing system 200 within the frame 120. Additionally, although the present door/window system 100 is described herein with particular types of seal activation systems 205 being positioned in particular locations in the panel 110, the door/window system 100 is not limited as to a particular type of seal activation system 205 and/or a particular location of the seal activation system 205 within the panel 110.

To prevent the forced opening of the panel 110, the sealing systems 200 are not limited as to a percentage of coverage between particular members of the frame 120 and/or panel 110. For example, the sealing systems 200 may only cover a fractional number (e.g., 10%, 50%, 85%) of the length between particular members of the frame 120 and/or panel 110. However, in certain aspects, the sealing systems 200 provide substantially complete coverage between the sash 160 of a panel 110 and the frame 120. In so doing, the combined sealing systems 200 can provide a seal substantially, completely around the panel 110.

Figure 10A:
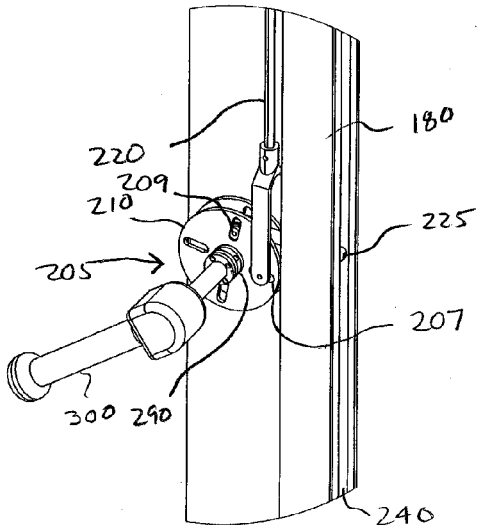
FIGS. 10A-10C are isolated detail views of the seal activation system in accordance with the inventive arrangements at another side of the panel, respectively, in the unlocked, partially engaged, and locked configurations.
Figure 9B:
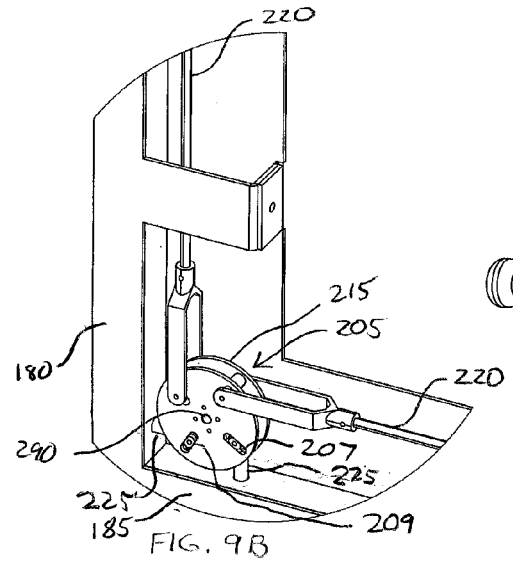
Figure 10B:
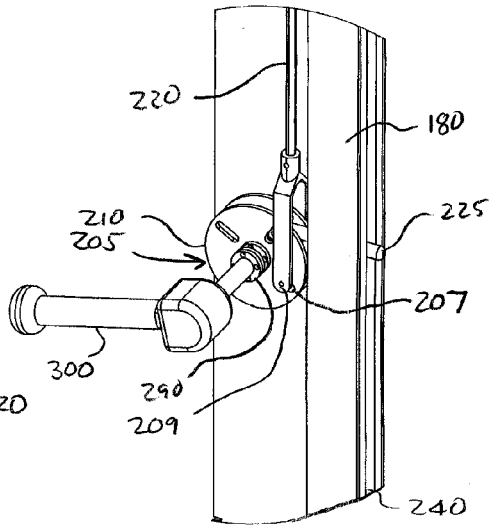
Figure 9C:
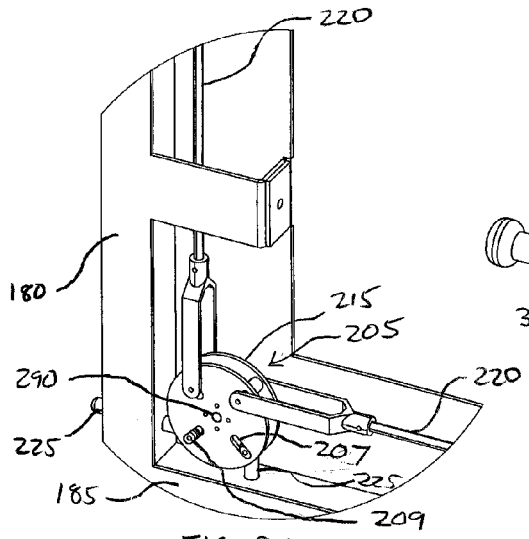
Figure 10C:
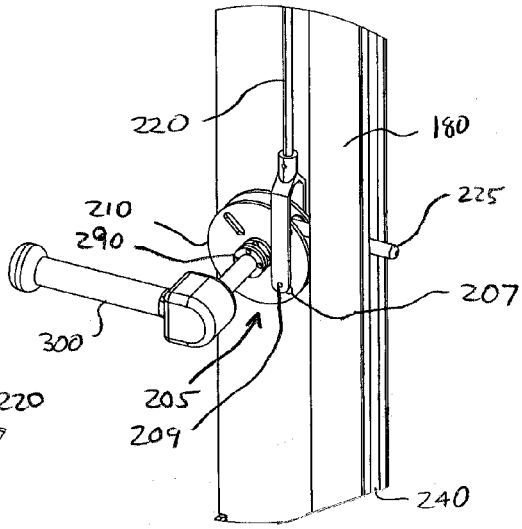
Figure 11:
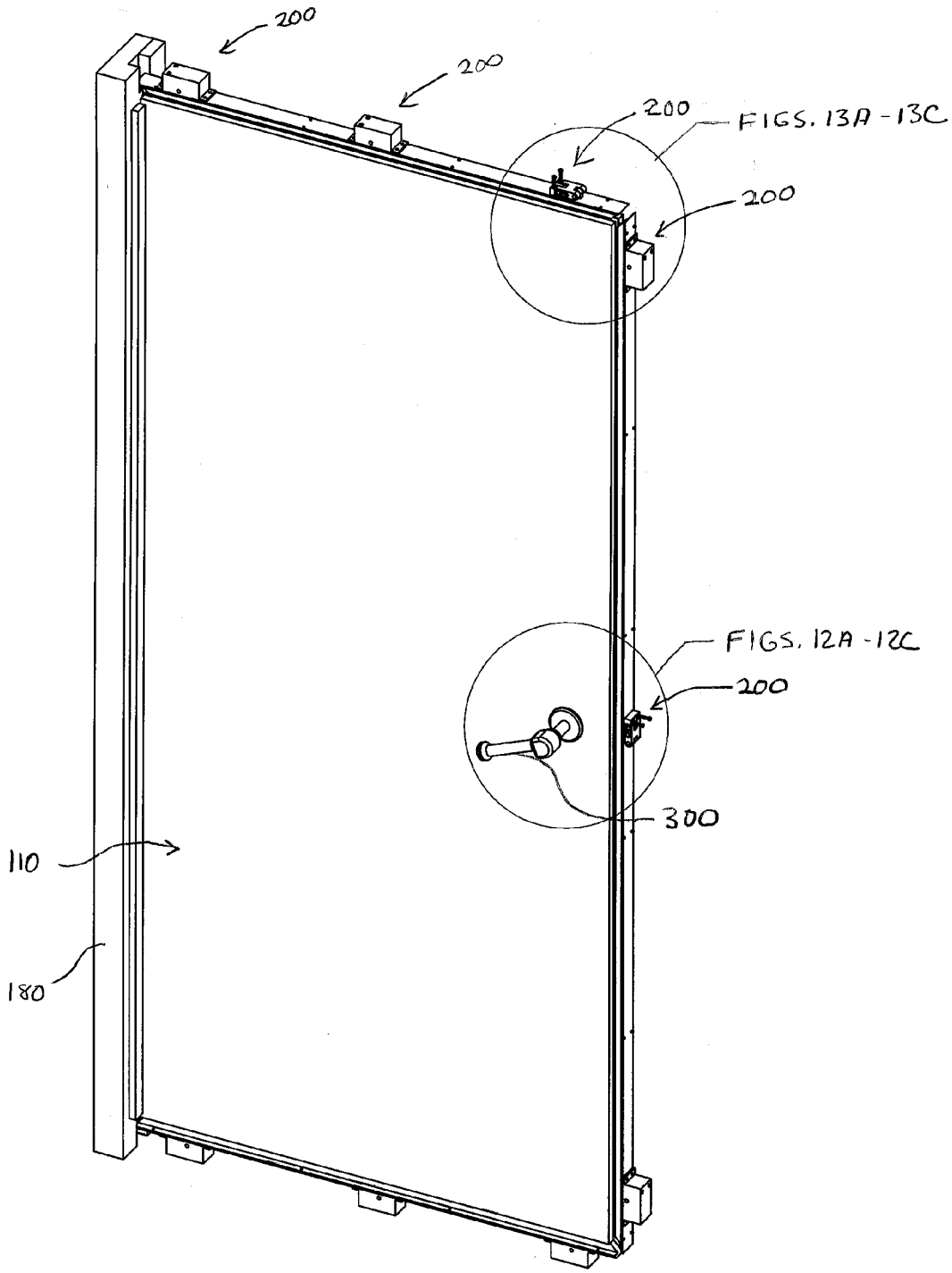
FIG. 11 is a perspective view of the panel of the door/window system and a partial perspective view of the frame and the sealing system in accordance with the inventive arrangements.
Figure 12A:
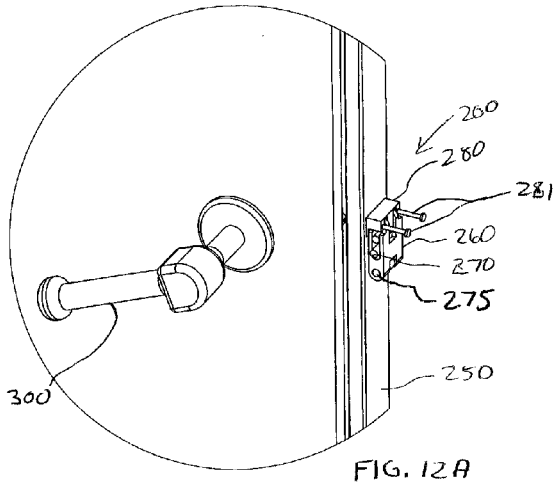
FIGS. 12A-12C are isolated detail views of the sealing system in accordance with the inventive arrangements and the closing system at a side of the frame, respectively, in the unlocked, partially engaged, and locked configurations.
Figure 12B:
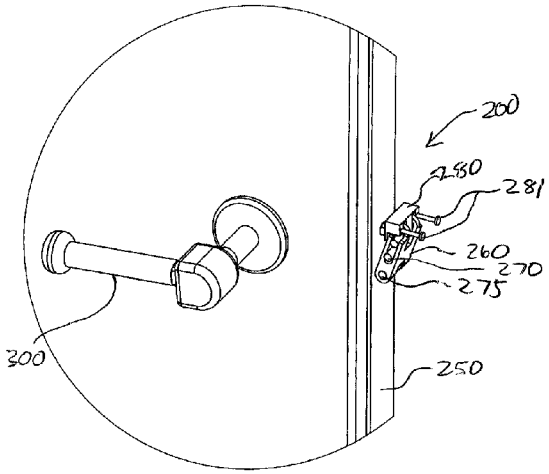
Figure 12C:
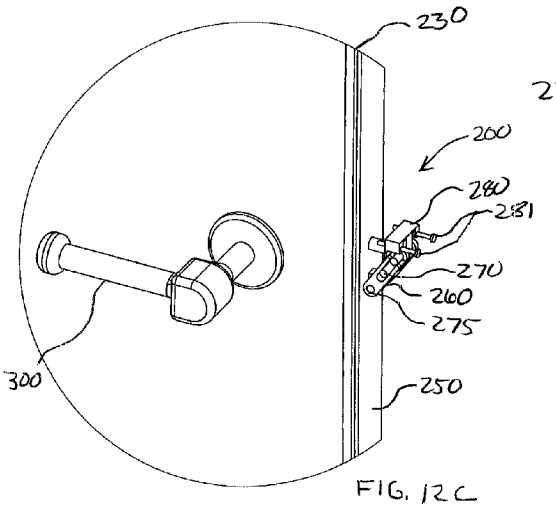

A closing system 300 moves the seal activation system 205 from the deactivated configuration (see FIG. 10A) to an activated configuration (see FIG. 10C). The closing system 300 may also move the seal activation system 205 from the activated configuration to the deactivated configuration. How the closing system 300 moves the seal activation system 205 from the deactivated configuration to the activated configuration (and back again) is not limited as to a particular manner and/or device. As can be readily envisioned, the configuration and operation of the closing system 300 may be determined by the configuration and operation of the seal activation system 205. A present example of the sealing system 300 employs the use of a door handle to rotate a portion of one of the seal activation system 205. Although this closing system 300 is shown as being manually operated, other devices capable of moving a seal activation system 205 are commonly known, such as magnetic, mechanical, and electromechanical devices.

FIGS. 6, 7A-7C, 8A-8C, 9A-9C, and 10A-10C further illustrate details of the seal activation systems 205. The seal activation systems 205 may be positioned within the sash 160 and/or the pane 170 of the panel 110. In certain aspects of the door/window system 100, the seal activation system 205 may interact with one or more sealing systems 200 within the frame 120. These sealing systems 200, in turn, may interact with the panel 110 to provide at least one seal 230 between adjacent members of the sash 160 of the panel 110 and the frame 120 in a locked configuration, and/or the sealing system 200 may interact with the panel 110 to prevent the movement of the panel 110 relative to the frame 120 in the locked configuration. In an unlocked configuration, the sealing system 200 may not provide the seal 230 and/or prevent movement of the panel 110 relative to the frame 120. Many types of sealing activation system 205 capable of this type of interaction with a sealing system 200 are known in the art, and the present door/window system 100 is not limited as to a particular type of sealing activation system 205 so capable.

At least one of the seal activation systems 205 may include at least one cam 210, 215. Although not limited in this manner, the cam 210, 215 can be fixed in position relative to the panel 110 by being rotated about a cam pivot 290 connected to the panel 110. Upon being rotated, the cam 210, 215 causes the movement of at least one activation pin 225. For example, upon being rotated in one direction, the cam 210, 215 may cause the movement of the activation pin 225 away from the sash 160, and upon being rotated in the opposite direction, the cam 210, 215 may cause the movement of the activation pin 225 towards the sash 160. Either directly or indirectly, depending upon the type of movement of the activation pin 225, the activation pin 225 positions the sealing system 200 in the locked configuration and/or the unlocked configuration.

Each cam 210 may move a single or multiple activation pins 225. For example, as illustrated in the drawings, a side cam 210 may be connected to single activation pin 225. As another example, a corner cam 215, by being positioned in a corner of the panel 110, may be connected to two activation pins 225 with each activation pin 225 extending from separate sides of the sash 160.

Although not limited in this manner, multiple cams 210, 215 may be provided along a single side of the sash 160. In so doing, the multiple cams 210, 215 may cause the activation of multiple sealing systems 200 positioned within a single side of the frame 120 adjacent the single side of the sash 160.

The seal activation system 205 may also include one or more cam connecting members 220 for interconnecting some or all of the cams 210, 215. In this manner, rotation of one of the cams 210, for example by the closing system 300, causes the other cams 210 to rotate. A single closing system 300 may be configured to simultaneously move each of separate seal activation systems 205 via, for example, use of the cam connecting members 220. However, in other aspects of the door/window system 100, multiple closing systems 300 may be provided to separately close one or multiple seal activation systems 205.

Both the cam connecting member 220 and/or the activation pin 225 may be connected to the cams 210, 215 via separate cam slot pivots 209. The cam slot pivot 209 may also allow the cam connecting member 220 and the activation pin 225 to pivot relative to the cams 210, 215. The cams 210, 215 may also include a cam slot 207 through which the cam slot pivot 209 may extend. The cam slot 207 allows the cam slot pivot 209 connecting the cams 210, 205 to either the activation pin 225 or the cam connecting member 220 to laterally slide relative to the cam 210, 215. As the cams 210, 215 rotate, the angular and/or positional relationship between the cams 210, 215 and the activation pin 225 and/or the cam connecting member 220 change. The cam slot 207 allows for easier pivoting of the cams 210, 215 relative to the activation pin 225 and/or the cam connecting member 220 by providing the cam slot pivot 209 additional positional flexibility.

Although the combination of cams 210, 215, cam connecting members 220, and activation pins 225 described and illustrated are one example of how a seal activation system 205 within the panel 110 may activate a sealing system 220 within the frame 120, the door/window system 100 is not limited in this particular manner. As can be readily envisaged by one skilled in the art, other types of linkages systems may be employed to act as a seal activation system 205 within the panel 110 to activate the sealing system 220 within the frame 120.

Figure 5A:
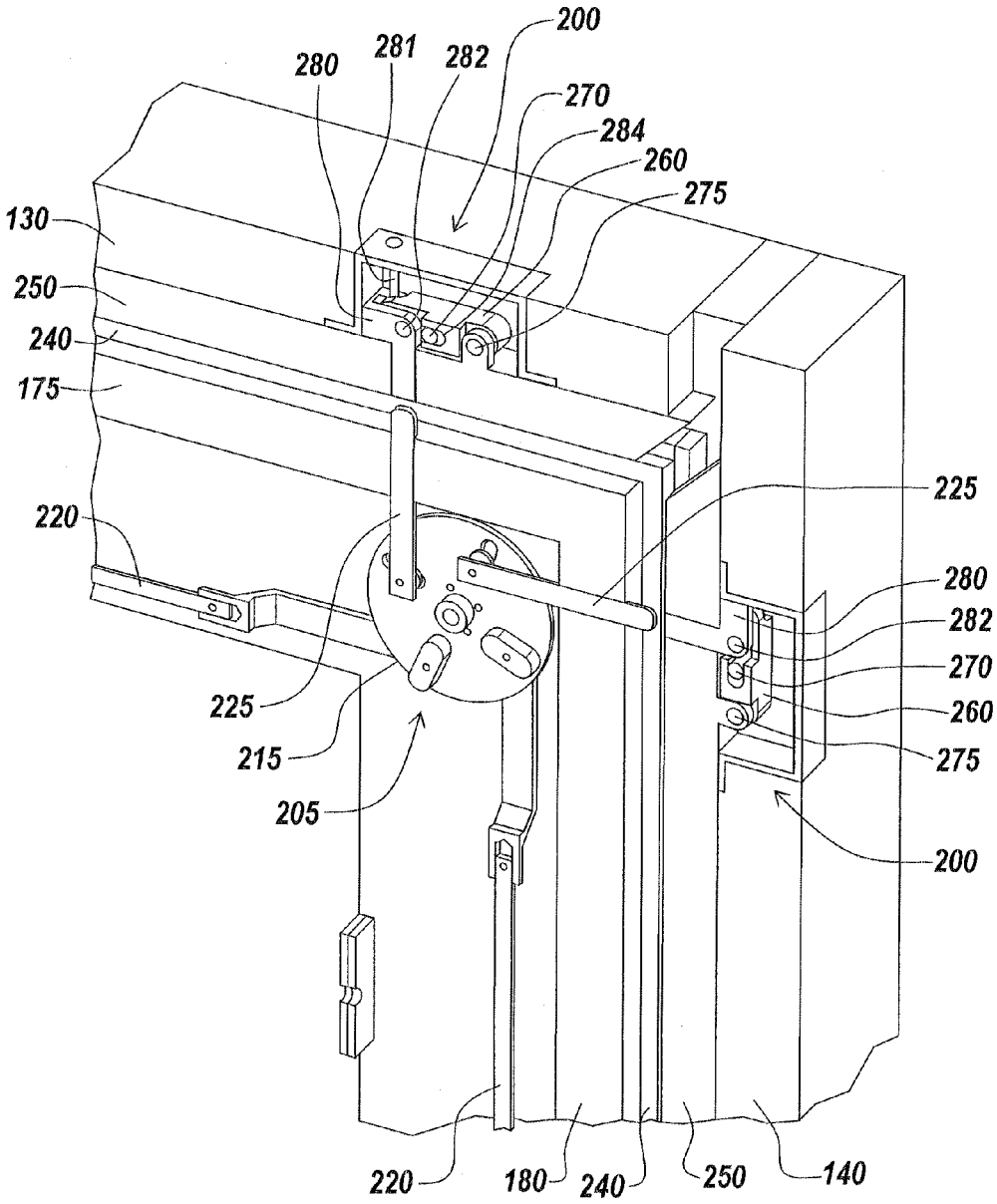
FIGS. 5A-5C are perspective views of the combination sealing system and seal activation system in accordance with the inventive arrangements at a corner of the door/window system, respectively, in the unlocked, partially engaged, and locked configurations.
Figure 5B:
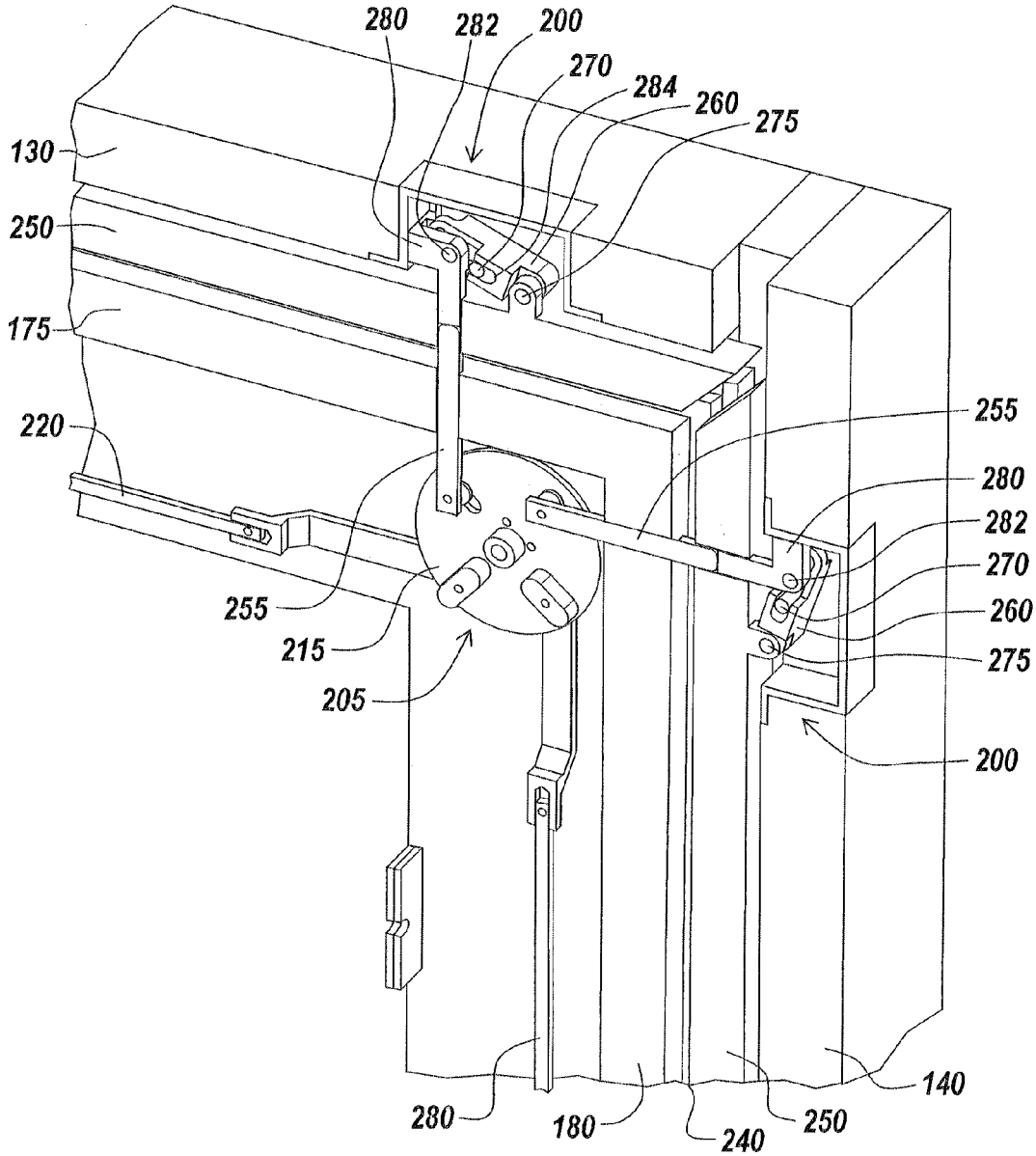
Figure 5C:
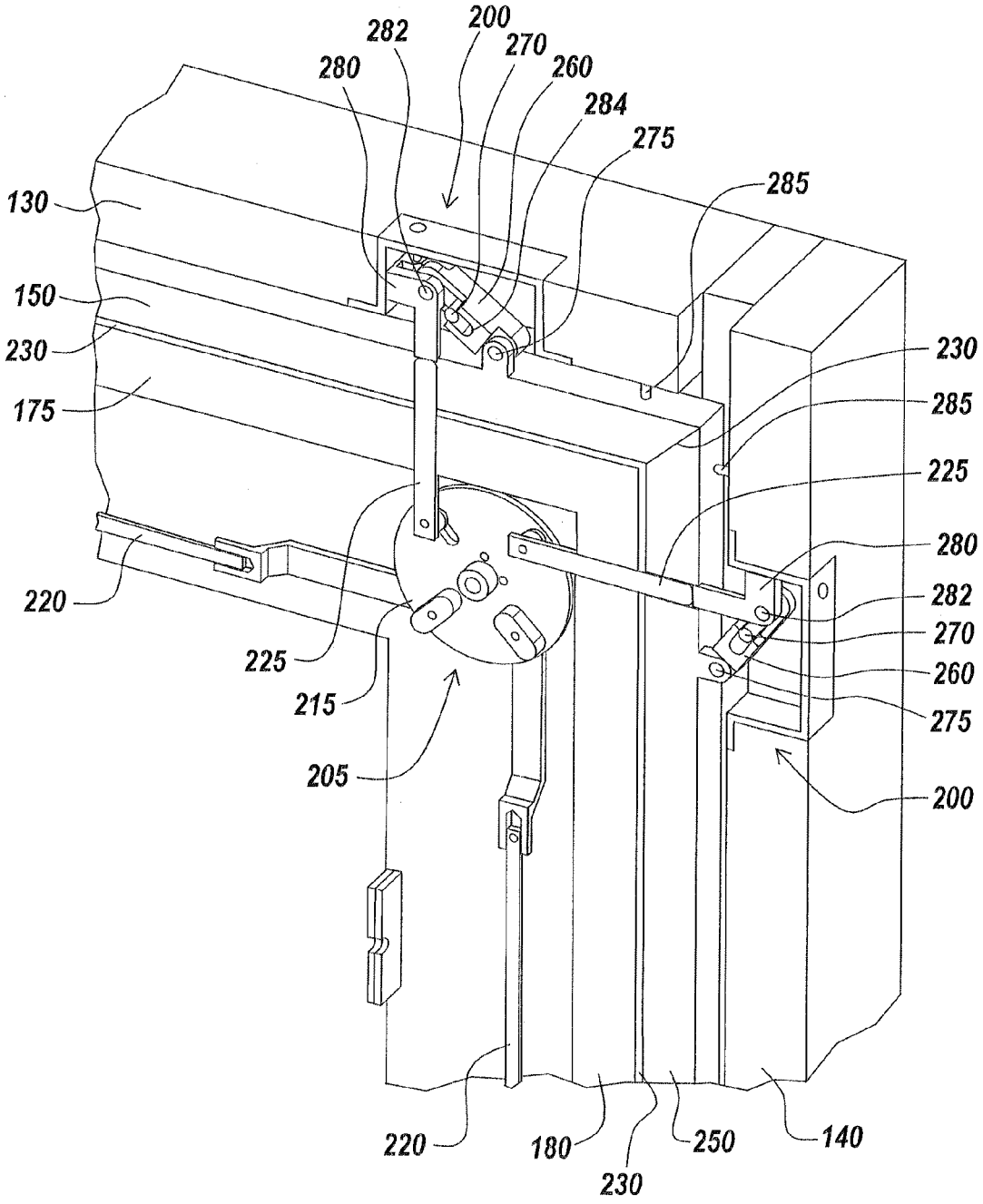
Figure 6:
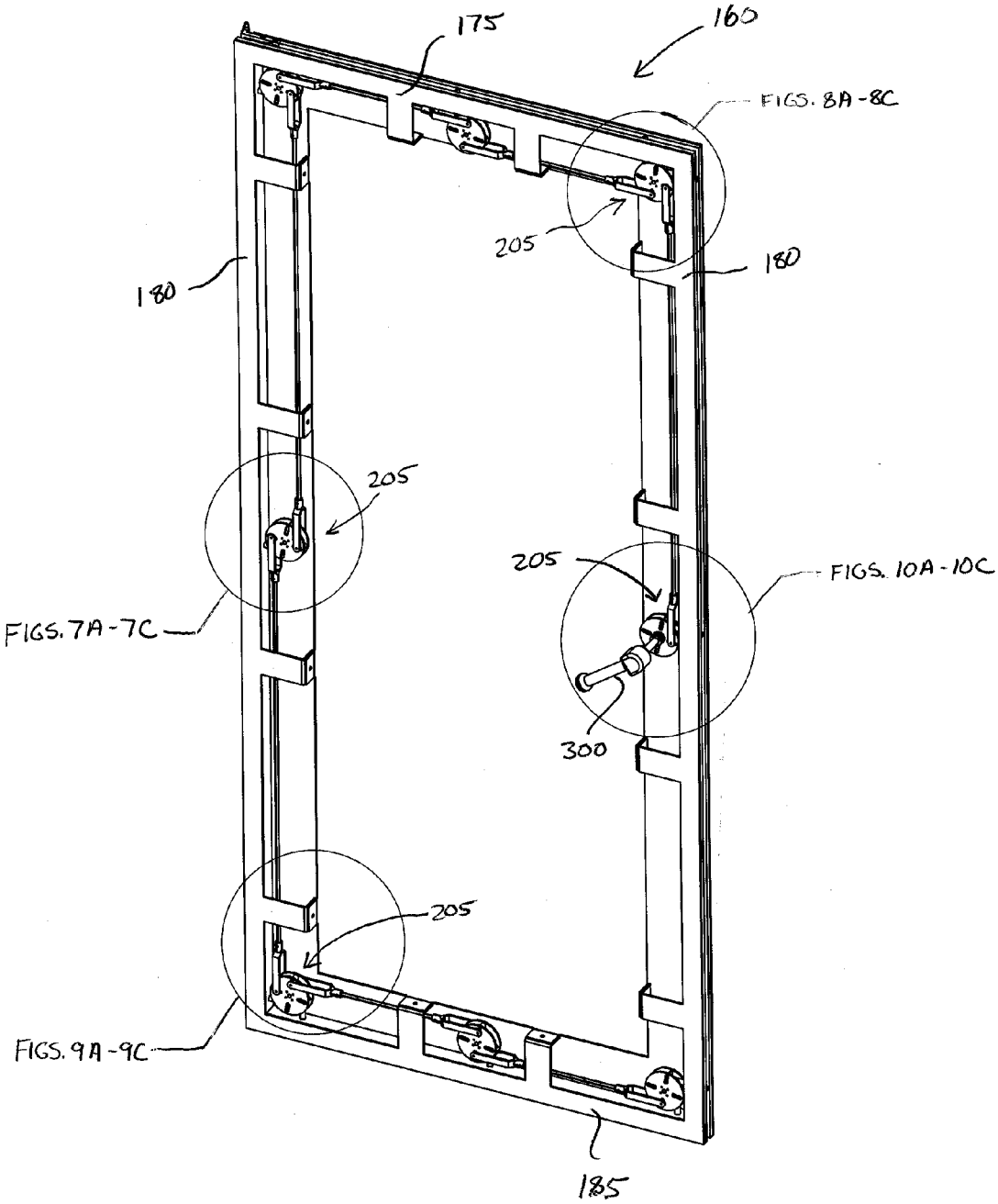
FIG. 6 is a perspective view of the panel of the door/window system in accordance with the inventive arrangements.
Figure 7A:
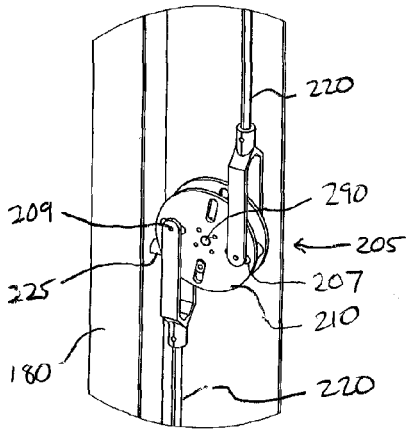
FIGS. 7A-7C are isolated detail views of the seal activation system in accordance with the inventive arrangements at one side of the panel, respectively, in the unlocked, partially engaged, and locked configurations.
Figure 7B:
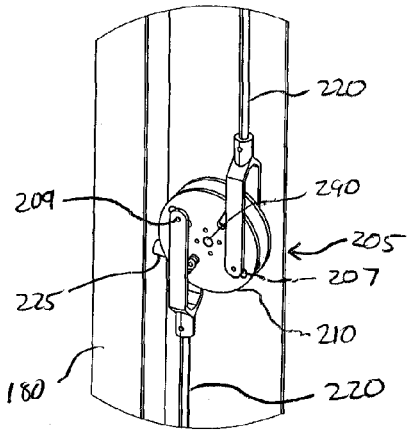
Figure 7C:
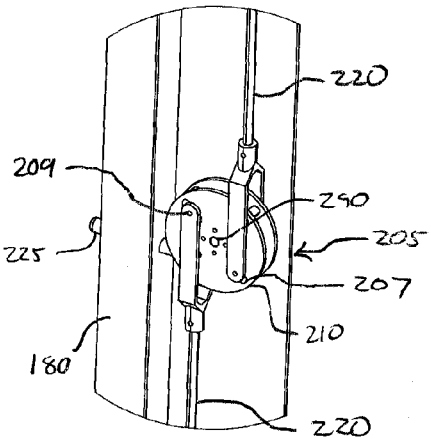
Figure 8A:
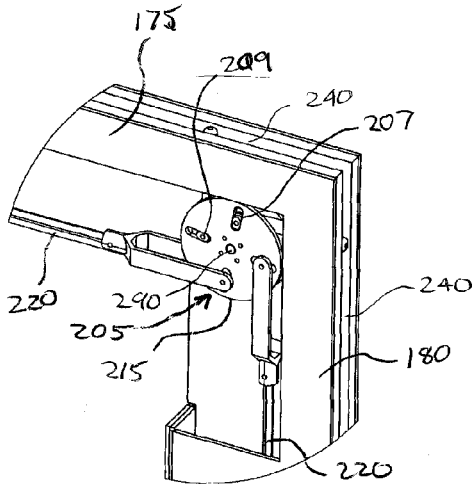
FIGS. 8A-8C are isolated detail views of the seal activation system in accordance with the inventive arrangements at one corner of the panel, respectively, in the unlocked, partially engaged, and locked configurations.
Figure 8B:
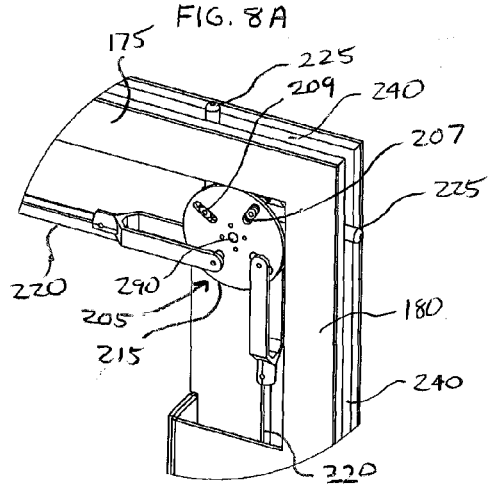
Figure 8C:
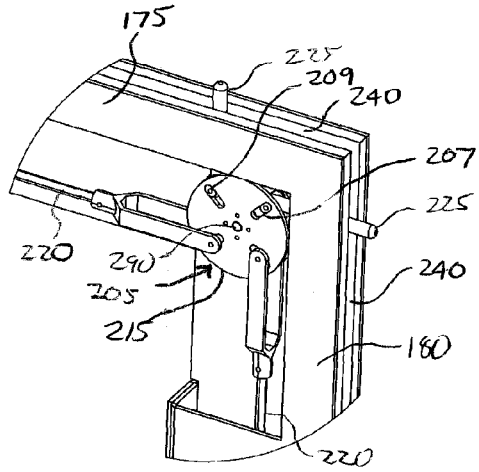
Figure 9A:
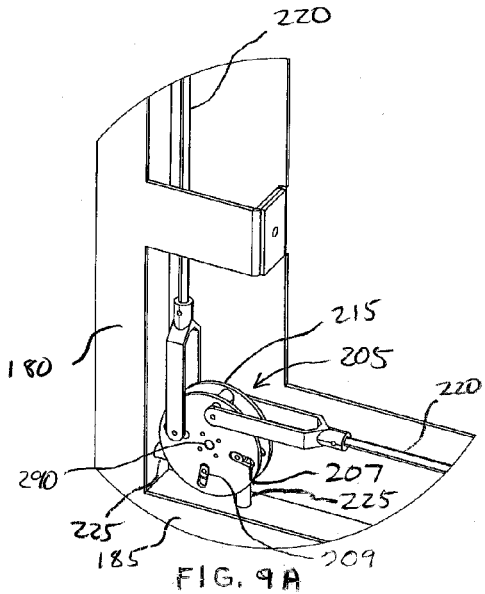
FIGS. 9A-9C are isolated detail views of the seal activation system in accordance with the inventive arrangements and a closing system at another corner of the panel, respectively, in the unlocked, partially engaged, and locked configurations.

FIGS. 11, 12A-12C, and 13A-13C further illustrate details of the sealing systems 200. Reference is also made to FIGS. 5A-5C, which illustrate the sealing system 200 used in conjunction with a seal activation system 205. The sealing systems 200 may be positioned within the frame 120 of the door/window system 100. In certain aspects of the door/window system 100, the sealing system 200 may interact with the panel 110 to provide at least one seal 230 between adjacent members of the sash 160 of the panel 110 and the frame 120 in a locked configuration, and/or the sealing system 200 may interact with the panel 110 to prevent the movement of the panel 110 relative to the frame 120 in the locked configuration. In an unlocked configuration, the sealing system 200 may not provide the seal 230 and/or prevent movement of the panel 110 relative to the frame 120. Many types of sealing systems 200 capable of one or more of these functions are known in the art, and the present door/window system 100 is not limited as to a particular type of sealing system 200 so capable. However, in certain aspects of the door/window system 100, the sealing system 200 provides both of these functions.

In certain aspects of the sealing system 200, the sealing system 200 employs the use of reciprocal motion device to form a seal 230 between adjacent members of sash 160 and the frame 120. The seal 230 is formed by engagement of an anchor 250 of the sealing system 200 with a portion of the sash 160. Although the sealing system 200 is not limited as to the particular portion of the sash 160 with which the anchor 250 engages to form the seal 230, in certain aspects of the sealing system 200, the seal 230 engages a surface of a slot 240 within members (e.g., header rail 175, stile rail 180, and sill rail 185) of the sash 160. Also, by having the anchor 250 being positioned with slot 240, movement of the panel 110 relative to the frame 120 can be prevented.

Figure 4A:
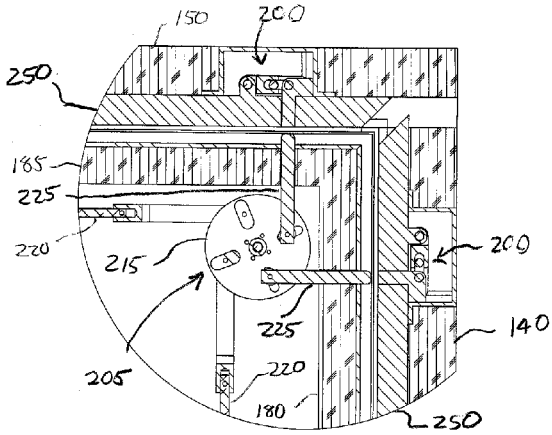
FIGS. 4A-4C are isolated detail views of the combination sealing system and seal activation system in accordance with the inventive arrangements at a corner of the door/window system, respectively, in the unlocked, partially engaged, and locked configurations.
Figure 4B:
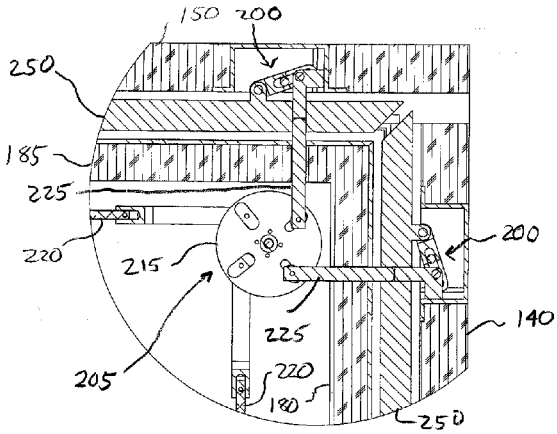
Figure 4C:
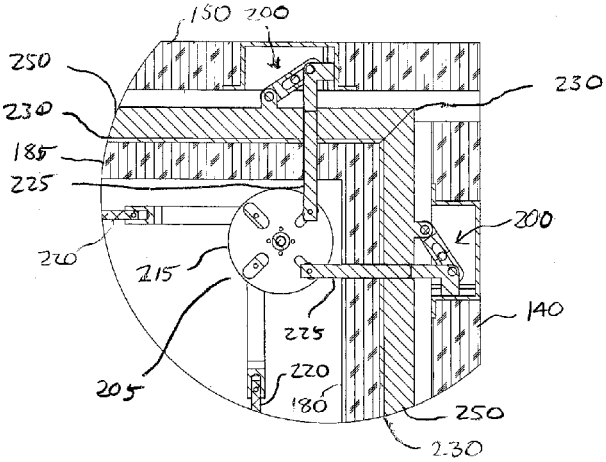
Figure 13A:
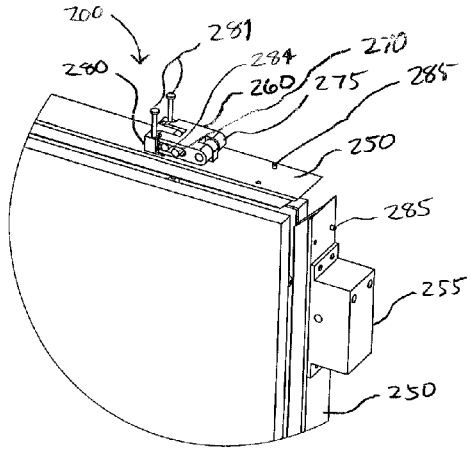
FIGS. 13A-13C are isolated detail views of the sealing system in accordance with the inventive arrangements at a corner of the frame, respectively, in the unlocked, partially engaged, and locked configurations.
Figure 13B:
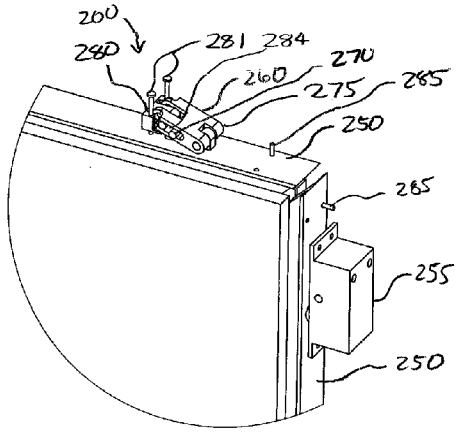
Figure 13C:
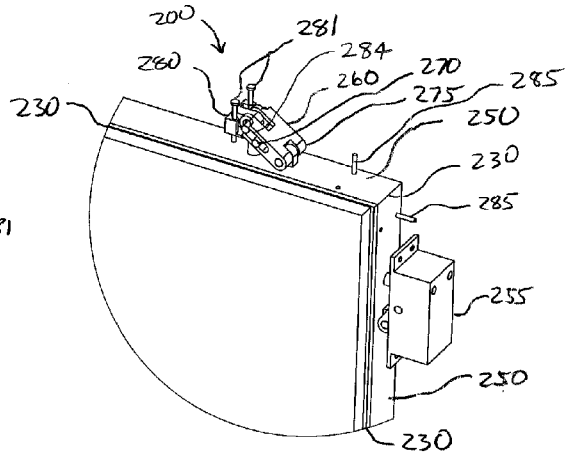

Additionally, as shown in FIGS. 4C, 5C, and 13C, a seal 230 may be formed by adjacent anchors 250 inter-engaging one another. In this manner, all the anchors 250 may be interconnected and surround the panel 110. The manner in which the anchors 250 inter-engage one another is not limited as to a particular configuration or device. However, in certain aspects, the adjacent anchors 250 include angled surfaces at their distal ends that mate with one another.

One or more anchor guides 285 may extend from the frame 120 and through the anchor 250. In so doing, the anchor guide 285 can guide movement of the anchor 250 along a predetermined path and prevent the anchor 250 from deviating from the predetermined path. This function of guiding the anchor 250 may also be provided by one or more activation pins 225 that extend from the sash 160. The activation pin 225 may be positioned to pass through the anchor 250 while engaging the sealing system 200 as will be described in greater detail below. In so doing, the activation pin 225 may also guide movement of the anchor 250 along a predetermined path and prevent the anchor 250 from deviating from the predetermined path.

The reciprocal motion device to form the seal 230 includes a pair of motions in opposite directions. For example, one of the motions may involve the movement of the anchor 250 substantially towards the sash 160, and the second of the motions may involve the movement of a portion of the sealing system 200 substantially away from the sash 160. The manner in which the reciprocal motion is created is not limited as to a particular device. For example, many types of linkages are known that are capable of transforming motion in one direction to direction in a substantially opposite direction.

In certain aspects of the sealing system 200, the reciprocal motion is created through the use of a rocker arm 260 that pivots about a rocker pivot 270. Although not limited in this manner, the rocker pivot 270 may be attached to a rocker housing 255 and/or the frame 120, and one side of the rocker arm 260 may be connected, either directly or indirectly, to the anchor 250. Although not limited in this manner, an anchor pivot 275 connects the rocker arm 260 to the anchor 250 and allows the rocker arm 260 to pivot relative to the anchor 250.

The movement of the anchor 250 may be accomplished through the use of repetitive portions of the sealing systems 200. For example, multiple rocker arms 260 may be attached to a single anchor 250. In so doing, the force used to move the anchor 250 may be balanced through the use of the multiple rocker arms 260.

Movement of the opposite side of the rocker arm 260 substantially away from the sash 160 creates the reciprocal movement of the side of the rocker arm 260 connected to the anchor 250 substantially towards the sash 160. This results in the anchor 250 moving substantially towards the sash 160. The sealing system 200 is not limited in the manner in which the opposite side of the rocker arm 260 is moved substantially away from the sash 160. Many types of devices so capable are known in the art, and the sealing system 200 is not limited as to a particular type of device so capable.

In certain aspects of the sealing system 200, however, the rocker arm 260 is configured to be moved by a movable member extending from the sash 160. The sealing system 200 is not limited as to a particular type of movable member extending from the sash 160 that is capable of moving the rocker arm 260 in a direction away from the sash 160; however, in certain aspects, the movable member is an activation pin 225. The movable member (e.g., the activation pin 225) may engage, either directly or indirectly, the rocker arm 260.

As illustrated in the figures, in a current aspect of the sealing system 200, an extension arm 280 may be provided to indirectly connect the rocker arm 260 to the movable member used to move the rocker arm 260. As shown in FIG. 5A, in the unlocked configuration, a distal end of the extension arm 280 may be positioned within the frame 120 so as to be substantially flush with a surface of the frame 120 proximate to the sash 160. For example, the extension arm 280 may be flush with the anchor 250. By having the distal end of the extension arm 280 substantially flush with the surface of the frame 120 proximate to the sash 160, the extension arm 280 does not extend beyond the surface, which could act as an obstruction. Also, the extension arm 280 does not create a hollow in the surface, which could act as a catch for debris while the sealing system 200 is in the unlocked configuration.

One or more extension guides 281 may extend from the frame 120 and through the extension arm 280. In so doing, the extension guides 281 can guide movement of the extension arm 280 along a predetermined path and prevent the extension arm 280 from deviating from the predetermined path. The extension guides 281 may also prevent the extension arm 280 from floating within the rocker housing 255 and/or maintain a desired relationship between the extension arm 280 and the rocker arm 260.

Although not limited in this manner, an extension arm pivot 282 connects the rocker arm 260 to the extension arm 280 and allows the extension arm 280 to pivot relative to the rocker arm 260. The rocker arm 260 may also include a rocker slot 284 through which the extension arm pivot 282 and/or the rocker pivot 270 may extend. The rocker slot 284 allows either the extension arm pivot 282 and/or the rocker pivot 270 to laterally slide relative to the rocker arm 260 and allow for easier pivoting of the rocker arm 260 relative to the extension arm 280 and/or the frame 120.

The sealing systems 200 are not limited as to the particular manner in which the sealing system 200 is positioned from the locked configuration to the unlocked configuration. For example, after the anchor 250 has been moved towards the sash 160 and the member has been withdrawn from engagement with the rocker arm 260, a resilient member (or other device) may move (either directly or indirectly) a portion of the rocker arm 260 attached to the anchor 250 away from the sash 160. In addition to or alternatively, the resilient member (or other device) may be directly connected to the anchor 250. As previously described, the engagement of one sealing system 200 may cause the engagement of one or more of the other sealing systems 200. In the same manner, the disengagement of one sealing system 200 may cause the disengagement of one or more of the other sealing systems 200.

Figure 14:
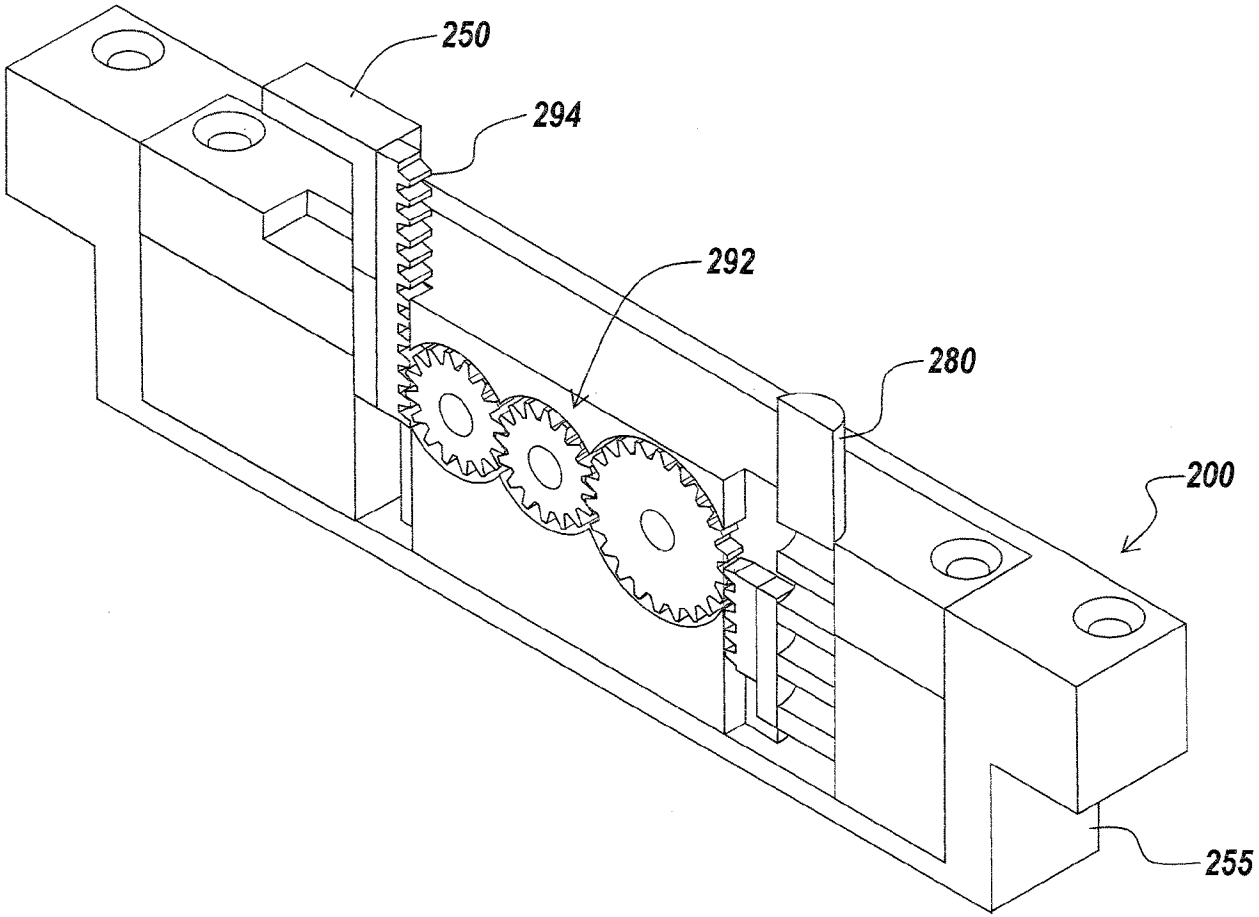
FIG. 14 is a perspective view of an alternative sealing system employing a reciprocal motion device in accordance with the inventive arrangements.

Another version of the sealing system 200 employing a reciprocal motion device is illustrated in FIG. 14. The sealing system 200 includes an extension arm 280 that indirectly connects a linkage 292 to the movable member (e.g., the activation pin 225) used to move the linkage 292. The linkage 292, as shown, includes a plurality of gears that transfer motion in one direction to motion in another direction. However, the linkage 292 is not limited in this manner as any device capable of transferring motion in one direction to motion in another direction is acceptable for use as the linkage 292. The motion from the movable member is transferred by the linkage 292 to a second extension arm 294 that is part of, or connected to, the anchor 250.

What is claimed is:

1. A system of sealing systems and one or more seal activation systems for use with a combination of a panel and a frame, the system comprising:

a first sealing system positioned within a first side of the frame, the first sealing system being one of the sealing systems;

a second sealing system positioned within a second side of the frame which is substantially perpendicular to the first side of the frame, the second sealing system being one of the sealing systems;

a first seal activation system for activating the first and second sealing systems, the first seal activation system being one of the one or more seal activation systems, the first seal activation system positioned within a first side of the panel and including:

a first movable member configured to engage the first sealing system, and a second movable member configured to engage the second sealing system;

wherein the first sealing system includes a third movable member, the second sealing system includes a fourth movable member, and when the first movable member moves toward the first side of the frame, the second movable member simultaneously moves toward the second side of the frame, resulting in:

the first movable member engaging the first sealing system and causing the third movable member to move towards the panel, and the second movable member engaging the second sealing system and causing the fourth movable member to move towards the panel.

2. The system of claim 1, wherein:

the third movable member is configured to engage a first portion of the panel to form a seal between the panel and the frame, and the fourth movable member is configured to engage a second portion of the panel to form a seal between the panel and the frame.

3. The system of claim 1, wherein:

the third movable member is configured to extend into a first slot within the panel to prevent movement of the panel relative to the frame, and the fourth movable member is configured to extend into a second slot within the panel to prevent the movement of the panel relative to the frame.

4. The system of claim 1, further comprising:

a second seal activation system for activating the second sealing system, the second seal activation system positioned within the panel.

5. The system of claim 4, wherein the first and second seal activation systems are interconnected with a connecting member, and positioning the first seal activation system in an engaged configuration causes positioning of the second seal activation system in an engaged configuration.

6. A system of sealing systems and one or more seal activation systems for use with a combination of a panel and a frame, the system comprising:

a first sealing system positioned within a first side of the frame, the first sealing system being one of the sealing systems;

a second sealing system positioned within a second side of the frame which is substantially perpendicular to the first side of the frame, the second sealing system being one of the sealing systems;

a first seal activation system positioned within the panel, the first seal activation system being one of the one or more seal activation systems, the first seal activation system including:

a first cam pivotally connected to the panel, a first activation pin pivotally connected to the first cam, and a second activation pin pivotally connected to the first cam, the second activation pin extending substantially perpendicular to the first activation pin, wherein the first seal activation system is configured to activate the first sealing system that includes a first movable member and the second sealing system that includes a second movable member, and when the first activation pin moves toward the first side of the frame, the second activation pin simultaneously moves toward the second side of the frame, resulting in:

the first activation pin engaging the first sealing system and causing the first movable member of the first sealing system to move towards the panel, and the second activation pin engaging the second sealing system and causing the second movable member of the second sealing system to move towards the panel.

7. The system of claim 6, wherein the first movable member of the first sealing system is configured to engage a portion of the panel to form a seal between the panel and the frame.

8. The system of claim 6, wherein the first movable member of the first sealing system is configured to extend into a slot within the panel to prevent movement of the panel relative to the frame.

9. The system of claim 6, further comprising:

a second seal activation system for activating the second sealing system, the second seal activation system positioned within the panel.

10. The system of claim 9, wherein the first cam and a second cam of the second seal activation system are interconnected with a cam connecting member, and positioning the first seal activation system in an engaged configuration causes positioning of the second seal activation system in an engaged configuration.

11. The system of claim 6, wherein the panel pivots relative to the frame.

12. A system of sealing systems and one or more seal activation systems for use with a combination of a panel and a frame, the system comprising:

a first sealing system positioned within a first side of the frame, the first sealing system being one of the sealing systems, the first sealing system including:

a first reciprocal motion device connected to the first side of the frame, and a first anchor connected to the first reciprocal motion device, wherein movement of a portion of the first reciprocal motion device away from the panel moves the anchor towards the panel;

a second sealing system positioned within a second side of the frame which is substantially perpendicular to the first side of the frame, the second sealing system being one of the sealing systems, the second sealing system including:

a second reciprocal motion device connected to the second side of the frame, and a second anchor connected to the second reciprocal motion device, wherein movement of a portion of the second reciprocal motion device away from the panel moves the second anchor towards the panel; and a first seal activation system for activating the first sealing system and the second sealing system, the first seal activation system being one of the one or more seal activation systems, the first seal activation system positioned within the panel and including a first movable member configured to engage the first sealing system and a second movable member configured to engage the second sealing system, wherein when the first movable member of the first seal activation system moves towards the first side of the frame, the second movable member of the first seal activation system simultaneously moves towards the second side of the frame, resulting in:

the first movable member engaging the first sealing system and causing the first anchor to move towards the panel, and the second movable member engaging the second sealing system and causing the second anchor to move towards the panel.

13. The system of claim 12, wherein:

the first anchor is configured to engage a first portion of the panel to form a seal between the panel and the frame, and the second anchor is configured to engage a second portion of the panel to form a seal between the panel and the frame.

14. The system of claim 12, wherein:

the first anchor is configured to extend into a first slot within the panel to prevent movement of the panel relative to the frame, and the second anchor is configured to extend into a second slot within the panel to prevent the movement of the panel relative to the frame.

15. The system of claim 12, further comprising:

a second seal activation system for activating the second sealing system, the second seal activation system positioned within the panel.

16. The system of claim 15, wherein the first and second seal activation systems are interconnected with a connecting member, and positioning the first seal activation system in an engaged configuration causes positioning of the second seal activation system in an engaged configuration.

17. The system of claim 12, wherein a plurality of reciprocal motion devices are connected to the first anchor or the second anchor.

18. A combined sealing system for use with a combination of a panel and a frame, comprising:

a first sealing system positioned within a first side of the frame for creating a seal between the first side of the frame and a first side of the panel; and a second sealing system positioned within a second side of the frame which is substantially perpendicular to the first side of the frame for creating a seal between the second side of the frame and a second side of the panel, a first seal activation system for activating the first sealing system, the first seal activation system positioned within the first side of the panel and including a first movable member configured to engage the first sealing system;

a second seal activation system for activating the second sealing system, the second seal activation system positioned within the second side of the panel and including a second movable member configured to engage the second sealing system;

the first sealing system includes a third movable member, the second sealing system includes a fourth movable member, when the first movable member moves toward the first side of the frame, the first movable member engages the first sealing system and causes the third movable member to move towards the panel, and when the second movable member moves toward the second side of the frame, the second movable member engages the second sealing system and causes the fourth movable member to move towards the panel.

19. The combined sealing system of claim 18, wherein each of the first and second sealing systems includes an anchor extending from the frame.

20. The combined sealing system of claim 18, wherein the panel pivots relative to the frame.

* * * * *